US006305251B1

(12) United States Patent
Pasbrig

(10) Patent No.: US 6,305,251 B1
(45) Date of Patent: Oct. 23, 2001

(54) UNIVERSAL WRENCH

(75) Inventor: Max Herbert Pasbrig, Orselina (CH)

(73) Assignee: Lacrex SA, Orselina (CH)

( * ) Notice: Subject to any disclaimer, the term of this patent is extended or adjusted under 35 U.S.C. 154(b) by 0 days.

(21) Appl. No.: 09/305,286

(22) Filed: May 5, 1999

(51) Int. Cl.[7] ..... B25B 13/28
(52) U.S. Cl. ..... 81/100; 81/109; 81/94
(58) Field of Search ..... 81/100–104, 109, 81/110, 94, 97, 99

(56) References Cited

U.S. PATENT DOCUMENTS

| | | | | |
|---|---|---|---|---|
| 1,037,387 | * | 9/1912 | Wilkinson | 81/109 |
| 1,093,388 | * | 4/1914 | Flack | 81/109 |
| 1,368,966 | * | 2/1921 | Ooley | 81/109 |
| 1,500,313 | * | 7/1924 | Hacheney | 81/109 |
| 1,566,764 | * | 12/1925 | Murphy | 81/109 |
| 2,050,102 | * | 8/1936 | Kujala et al. | 81/100 |
| 4,296,655 | * | 10/1981 | Tesoro | 81/405 |
| 4,651,597 | * | 3/1987 | Yang | 81/99 |
| 4,893,528 | * | 1/1990 | Chung-Hsing | 81/100 |
| 6,026,714 | * | 2/2000 | Chang | 81/100 |

FOREIGN PATENT DOCUMENTS

| | | | | |
|---|---|---|---|---|
| 278376 | * | 10/1913 | (DE) | 81/109 |
| 2595607 A | * | 9/1987 | (FR) | 81/102 |
| 10288 | * | 5/1994 | (GB) | 81/109 |

* cited by examiner

*Primary Examiner*—Joseph J. Hail, III
*Assistant Examiner*—David B. Thomas
(74) *Attorney, Agent, or Firm*—Millen, White, Zelano & Branigan, P.C.

(57) ABSTRACT

A universal wrench includes a handle that is made of flat parts that are connected by pins and are provided with a coating. The flat parts have clamping parts on their ends and have offsets which form a support slot for a clamping body. The clamping body has clamping surfaces and a bearing flange with support slot that has a varying diameter for a swivel axis which can move in recesses of the handle parts against a spring on which the wrench body pivots and is mounted in an adjustable manner in the gripping openings.

18 Claims, 5 Drawing Sheets

UNIVERSAL WRENCH

FIELD OF THE INVENTION

The invention relates to a universal wrench.

BACKGROUND OF THE INVENTION

Known univeral wrenches have the drawback that the wrench body is held only conditionally on the parts that are to be gripped. Moreover, it is possible to secure the wrench body in the selected position in the support slot and to make an intended change of the gripping opening and the gripping angle only to a limited extent.

SUMMARY OF THE INVENTION

An object of the invention is to improve universal wrench as of the above-mentioned type in such a way that the wrench body is held against the part that is being gripped and in a selected position in the support slot so that a change of the gripping opening and the gripping angle is possible to an unlimited extent.

The design of the handle and the wrench body according to the invention and the arrangement of spring means make it possible to hold the wrench body against the part that is being gripped and in a selected position in the support slot as well as to change the gripping opening and the gripping angle.

The handle is suitably provided with a coating made of suitable material for better handling.

The universal wrench that is thus designed can be used according to the type of ratchet tool employed since the wrench body is held tightly against the part that is being gripped by an arrangement of spring means. It is advantageous if the swivel axis of the wrench body has varying diameters that correspond to respective recesses in the support slot of the wrench body and can be moved against the pressure of a spring in such a way that engaging and disengaging of the swivel axis can take place in the selected recess in the support slot of the wrench body so as to be able to make a change in the gripping opening and the gripping angle.

BRIEF DESCRIPTION OF THE DRAWINGS

The invention will be described in more detail below based on four embodiments that are depicted schematized in the drawings.

DETAILED DESCRIPTION

Figure 1:
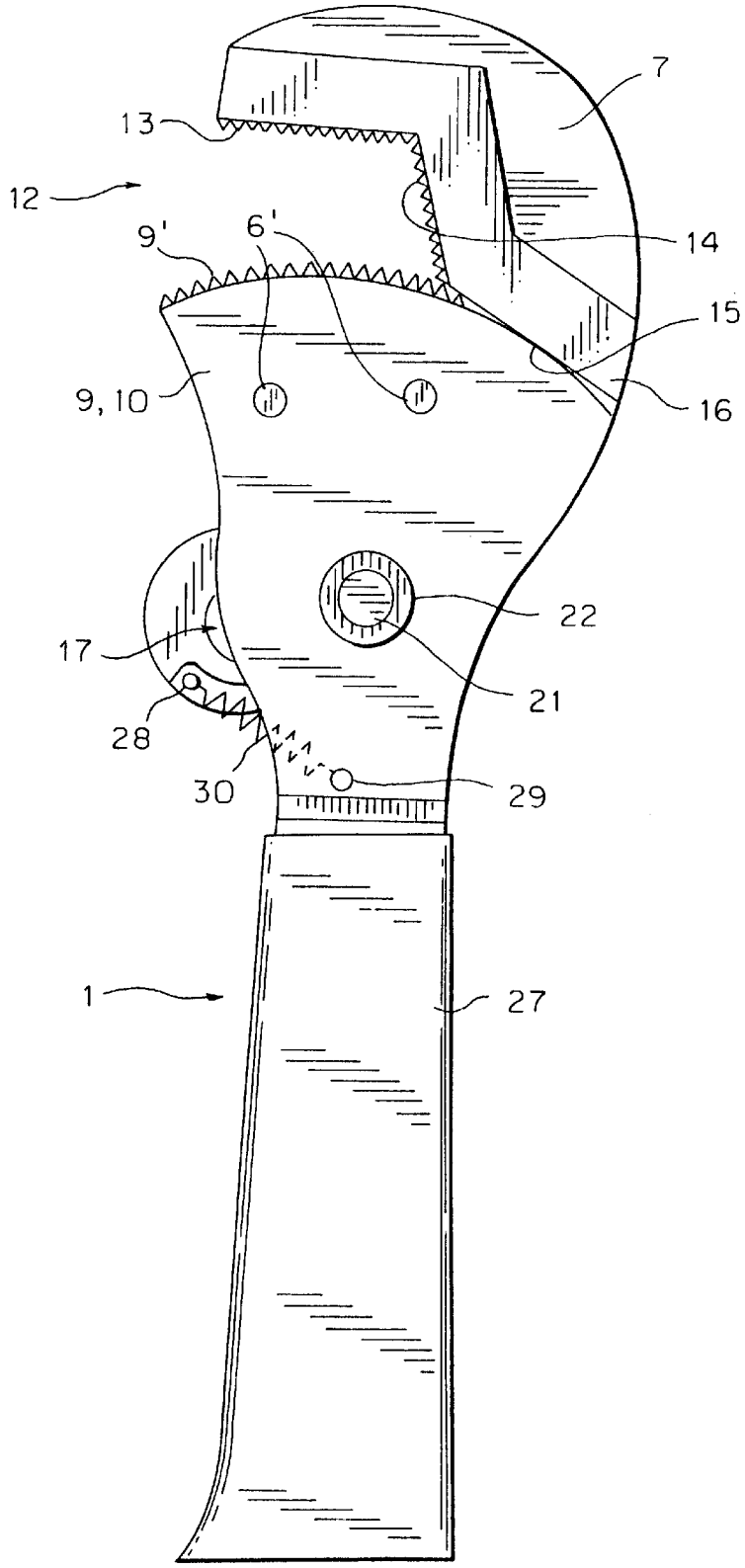
FIG. 1 is a side view of a first embodiment of the invention.

The depicted universal wrenches includes a handle 1 and wrench bodies 7, 8. Handle 1, FIGS. 1, 2 and 3, includes two flat two flat parts 2 and 3, which are held together by tie bolts 4, 5 and 6, whereby tie bolt 6 is also designed as a stop pin for wrench body 7, 8. For better handling, handle 1 is provided with a coating 27. On their upper ends, handle parts 2, 3 are equipped with offsets 2', 3', which offsets form prongs 1*a* and 1*b* that form a forked end which provides a support slot 10 for wrench bodies 7, 8. Support slot 10 is open and is equipped in FIG. 1 on its upper part with a clamping part 9 that overlaps the latter, and clamping part 9 is fastened with pins 6, 6' to handle parts 2, 3 and is equipped with a fluting 9'. In FIG. 3, the upper ends of handle parts 2, 3 are designed nose-shaped as clamping part 9 and are equipped with fluting 11. Handle parts 2, 3 are equipped with recesses 17 as accommodation for swivel axis 21 and recess 29 for holding pin 30 for spring 28.

Figure 4:
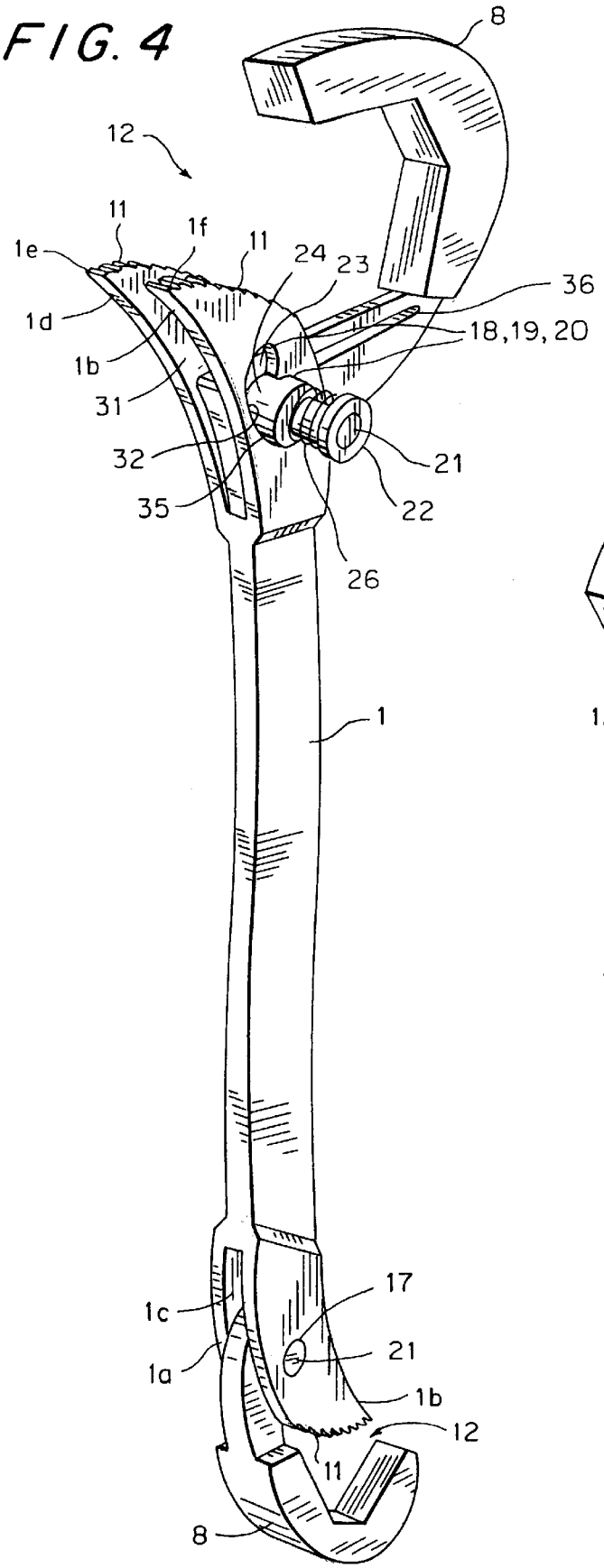
FIG. 4 is a side perspective view of a third embodiment of the invention.
Figure 4A:
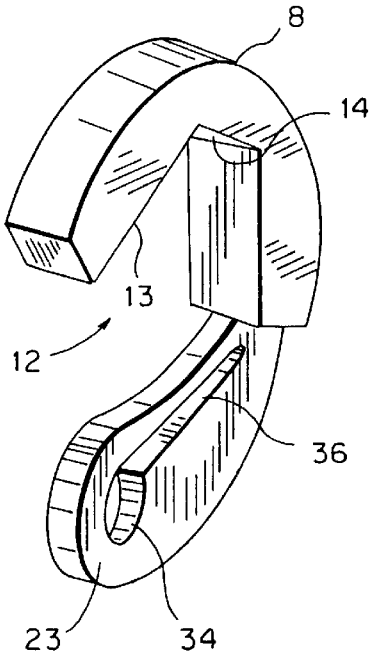
FIG. 4*a* is a side perspective view of a wrench body of FIG. 4.

Handle 1 in FIG. 4 includes a part with projections in form of prongs 1*a*, 1*b* that are made nose-shaped at the ends between which a slot 31 is designed. The projections which form the prongs 1*a*, 1*b* are equipped with a curved recess 32 that has varying diameters for the accommodation of swivel axis 21 of wrench body 8. For adjustment and holding of wrench body 8, swivel axis 21 is equipped with a spring 26 and with annular parts 22 on its ends. Wrench body 8 is equipped in bearing flange 23 with a recess 34 for swivel axis 21 and is loaded by a spring 35 that is attached in slot 31 of the handle and is held in a recess 36 of bearing flange 23.

Figure 2:
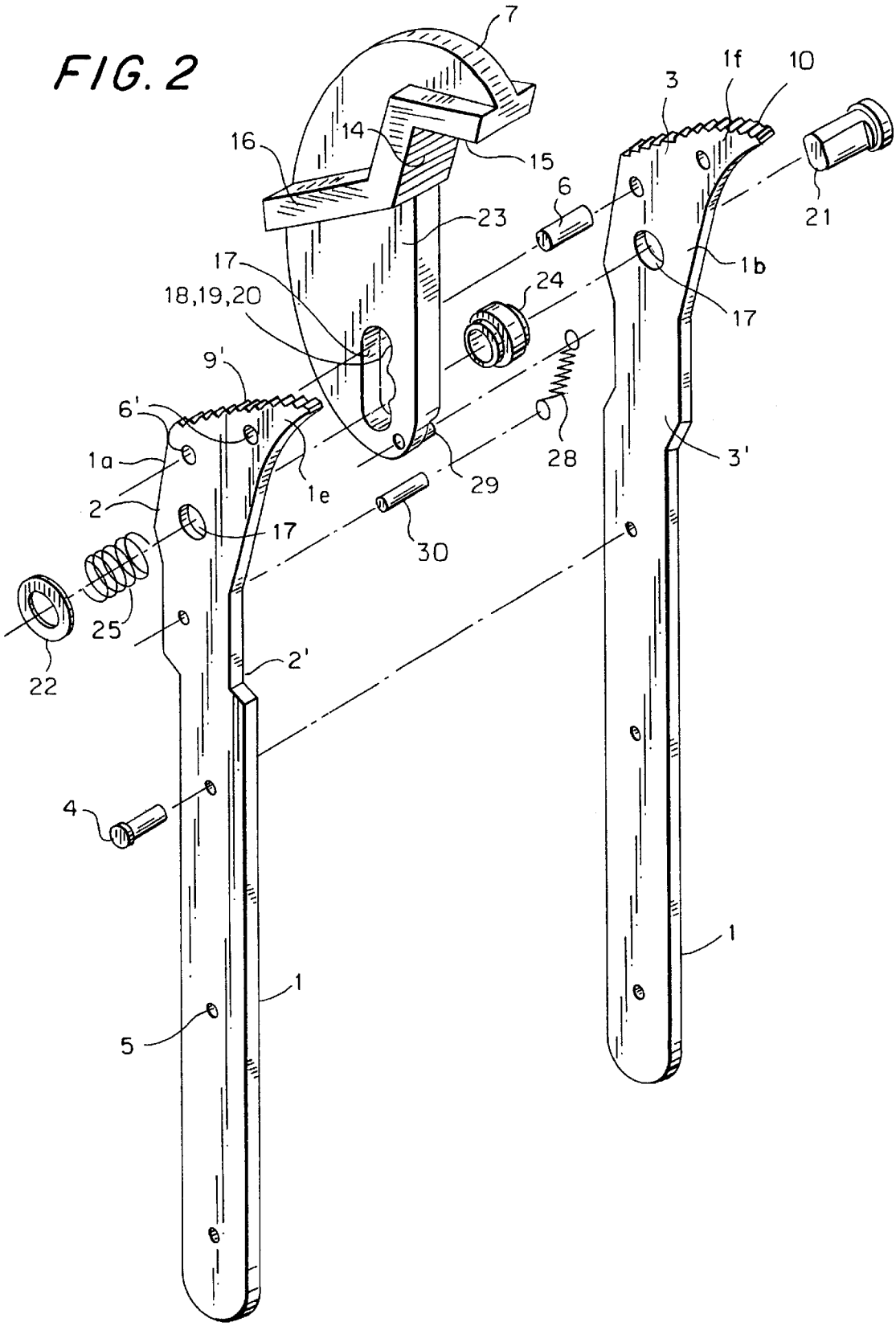
FIG. 2 is an exploded perspective view of the embodiment of FIG. 1.
Figure 3:
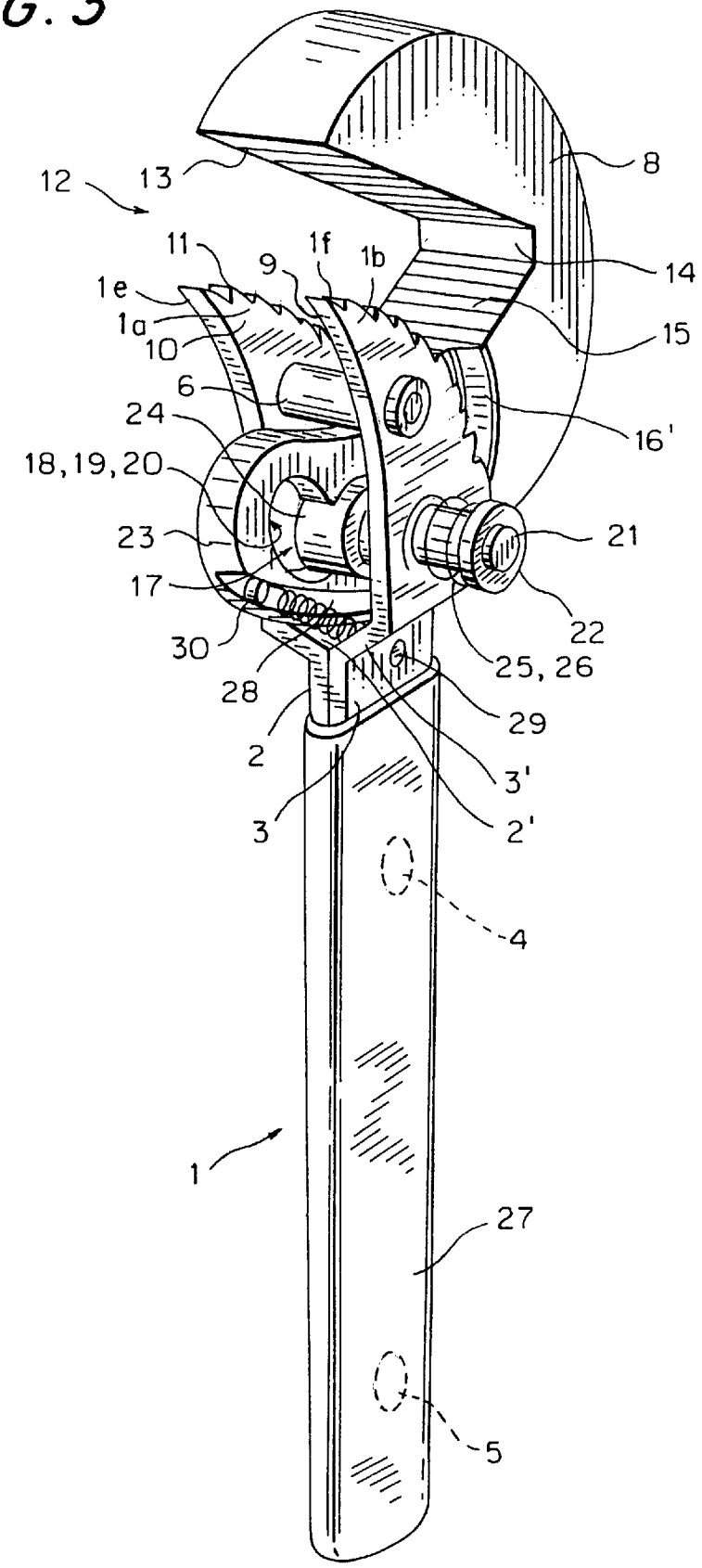
FIG. 3 is a side perspective view of a second embodiment of the invention.

Wrench body 7 in FIG. 1 and FIG. 2 consists of a head part and clamping part 7', which is equipped with a reinforcement piece 16 with clamping surfaces 14, 15 with fluting, a bearing flange 23 which is equipped with a support slot 20 with a varying internal diameter 18, 19 for swivel axis 21.

The wrench body of FIG. 3 includes a head part 8 with clamping surfaces 13, 14, 15, and a bearing flange 23 which is equipped with a support slot 20 with varying internal diameters 18, 19 for swivel axis 21. Wrench bodies 7, 8 are accommodated in support slot 20 of handle 1 at swivel axis 21, in such a way that the swivel axis is made to swivel around the handle ends and can be adjusted in gripping opening 12 by swivel axis 21 in support slot 20 of wrench body 7, 8 that has varying internal diameters 18, 19. Spring elements 26, 28, 35, which are actively connected to handle 1 and wrench bodies 7, 8, hold wrench bodies 7, 8 against the parts that are being gripped in such a way that ratchet movements are possible.

Swivel axis 21 of FIG. 1, FIG. 2 and FIG. 3, has a reinforced part 24 in the center and is accommodated in recesses 17 of handle parts 2, 3 and can be moved against the pressure of spring 25, which is arranged on swivel axis 21 between handle part 3 and annular part 22.

Figure 5:
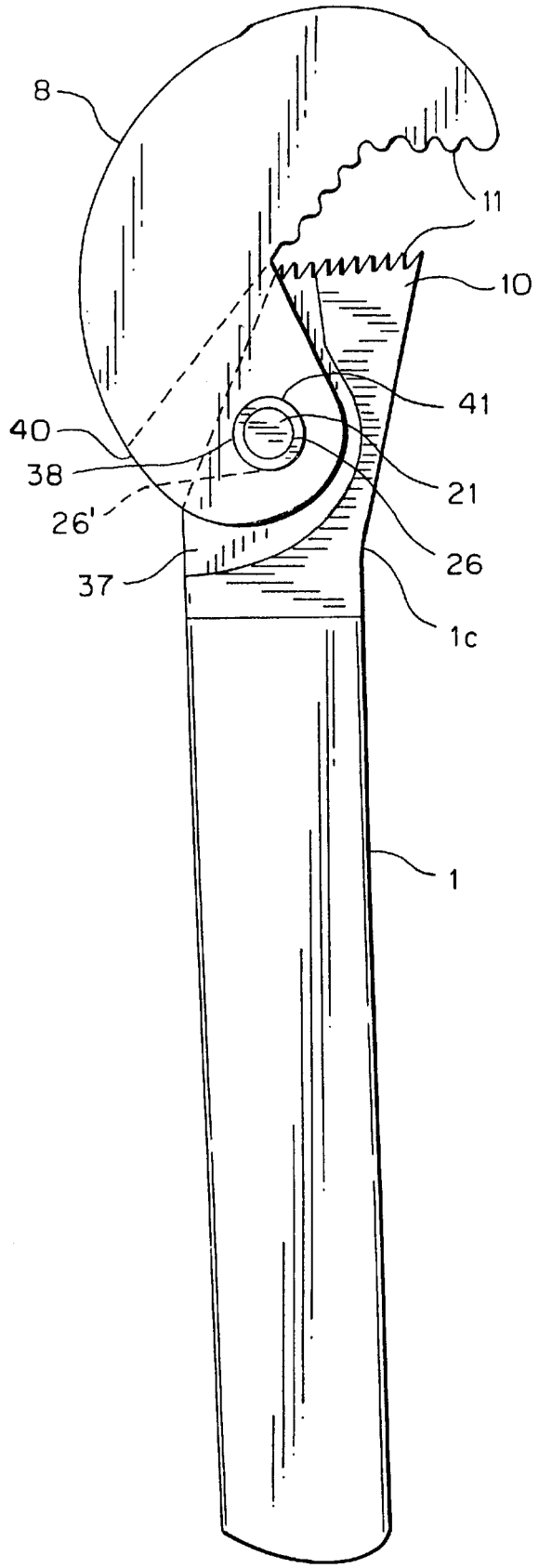
FIG. 5 is a side perspective view of a fourth embodiment of the invention.

On one end, handle 1 in FIG. 5 has a thicker part 1*c* with clamping part 10 and a recess 37 on both sides for the accommodation of wrench body 8 as well as a recess 38 for swivel axis 21. Wrench body 8 has the thickness of part 1*c* of handle 1 and is equipped at its lower part with a recess 40 for handle part 37 as well as a recess 41 for swivel axis 21, which is connected tightly with wrench body 8.

To keep wrench body 8 against clamping part 11 of handle 1, a spring 26 is arranged on swivel axis 39 whose leg 26' has supported it in recess 40 of wrench body 8 and is fastened there.

With these universal wrenches, parts and connecting elements of various sizes and shapes can be gripped regardless of whether these are accessible axially or radially.

It is also possible to adjust the wrench body as required in the gripping opening and the gripping angle to be able to better grip the parts and connecting elements and to keep them against it.

The novelty is not limited to the depicted handle and wrench body shapes or the type and arrangement of the spring elements, since also other shapes and arrangements are provided.

What is claimed is:

1. A universal wrench with at least one open wrench body, on the end of a handle for snug holding of a part that is to be gripped in such a way that the wrench body is held against the part that is being gripped and is pivotal and adjustable in a gripping plane relative to the handle, comprising:

a forked end portion (1*a*) disposed on at least one end of the handle (1), defining an open slot (10) which receives a bearing flange extending from the wrench body, the wrench body (7,8) having a clamping surface (13,14) facing the forked end portion, the forked end portion including two prongs (1*a* and 1*b*) having free ends (1*e* and 1*f*) which are spaced apart to define the open slot (10) with each prong having an arcuate gripping surface (11) facing the clamping surface (13,14) of the wrench body, the arcuate gripping surfaces (11) of each prong (1*a* and 1*b*) being fluted; and a mounting arrangement for pivoting the wrench body (8) to the handle comprising a pin-in-slot connection (34 and 35) joining the wrench body (8) to the prongs (1*a* and 1*b*) wherein the gripping space is defined by a gap (12) between the clamping surfaces on the wrench body (8) and the prongs (1*b* and 1*d*).

2. A universal wrench according to claim 1, wherein the wrench body (7, 8) is equipped with a reinforcement piece (16') and a bearing flange (23) with a support slot (20) with varying diameters (18, 19) for receiving a swivel axis (21).

3. A universal wrench according to claim 1, wherein the wrench body (7, 8) are loaded by a spring (26, 28, 35) that is connected with handle (1) or swivel axis (21) and are equipped with a recess (40).

4. A universal wrench according to claim 3 wherein the swivel axis (21) has a reinforcement piece (24) and is arranged to move in recesses (17, 32) of handle (1) and is equipped with annular parts (22) and a spring (25), which is fastened between handle parts (2, 3) and an annular part (22).

5. A universal wrench according to claim 4, wherein handle (1) includes handle parts (2, 3), which are connected with one another with pins (4, 5, 6), the handle parts being nose-shaped on their ends and the ends being equipped with clamping parts (9, 10) with fluting (11).

6. A universal wrench according to claim 5 wherein handle parts (2, 3) are equipped with offsets (2', 3'), which form a support slot (10) for wrench bodies (7, 8).

7. A universal wrench according to claim 6 wherein handle parts (2, 3) are equipped with a recess (17) for the accommodation of swivel axis (21).

8. A universal wrench according to claim 1 wherein handle consists of a part and is equipped on the ends with nose-shaped nozzles (1*a*, 1*b*) between which a slot (31) for wrench bodies (7, 8) is made.

9. A universal wrench according to claim 8, wherein nozzles (1*a*, 1*b*) of handle (1) are equipped with a recess (32) that has varying diameters (18, 19, 20) for swivel axis (21) that is mounted to be able to move therein.

10. A universal wrench according to claim 9 wherein wrench bodies (7, 8) are arranged on both ends of handle (1).

11. A universal wrench according to claim 10 wherein handle (1) is equipped with a thicker part (1*c*) with recesses (37) on both sides.

12. A universal wrench according to claim 1, wherein swivel axis (21) has a reinforcement piece (24) and is arranged to move in recesses (17, 32) of handle (1) and is equipped with annular parts (22) and a spring (25), which is fastened between handle parts (2,3) and annular part (22).

13. A universal wrench according to claim 1, wherein handle (1) includes handle parts (2,3), which are connected with one another with pins (4,5,6), the handle parts being nose-shaped on their ends and the ends being equipped with clamping parts (9, 10) with fluting (11).

14. A universal wrench according to claim 5, wherein handle parts (2,3) are equipped with a recess (17) for the accommodation of swivel axis (21).

15. A universal wrench according to claim 1, wherein nozzles (1*a*, 1*b*) of handle (1) are equipped with a recess (32) that has varying diameters (18, 19, 20) for swivel axis (21) that is mounted to be able to move therein.

16. A universal wrench according to claim 10, wherein wrench bodies (7,8) are arranged on both ends of handle (1).

17. A universal wrench according to claim 1, wherein handle (1) is equipped with a thicker part (1*c*) with recesses (37) on both sides.

18. A universal wrench of claim 1 wherein the handle (1) has two parts (2 and 3) with a prong (1*a*, 1*b*) on each part, the two parts (2 and 3) being joined together to form the handle (1) with the prongs (1*a*, 1*b*) being offset to form the gap (10) therebetween for receiving the wrench body (7,8).

* * * * *